US006343408B1

(12) United States Patent
Neugebauer

(10) Patent No.: US 6,343,408 B1
(45) Date of Patent: Feb. 5, 2002

(54) FLUIDTIGHT ZIP FASTENER

(75) Inventor: Horst Gotthard Neugebauer, Giesen Hasede (DE)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/576,679

(22) Filed: May 23, 2000

(30) Foreign Application Priority Data

May 28, 1999 (DE) ..... 199 24 539

(51) Int. Cl.[7] ..... A44B 19/32
(52) U.S. Cl. ..... 24/389; 24/403; 24/392
(58) Field of Search ..... 24/384, 389, 401, 24/403, 391, 415, 417, 428

(56) References Cited

U.S. PATENT DOCUMENTS

| | | | | |
|---|---|---|---|---|
| 3,501,816 A | | 3/1970 | Heimberger | |
| 3,668,745 A | | 6/1972 | Krupp | |
| 3,874,037 A | | 4/1975 | Takamatsu | |
| 4,099,302 A | * | 7/1978 | Frohlich et al. | 24/392 |
| 4,580,321 A | * | 4/1986 | Tanikawa et al. | 24/389 |
| 4,604,774 A | * | 8/1986 | Yamaguchi et al. | 24/389 |
| 4,607,416 A | * | 8/1986 | Tanikawa et al. | 24/389 |
| 4,724,586 A | | 2/1988 | Tsubokawa et al. | |
| 5,386,616 A | * | 2/1995 | Norvell | 24/389 |

FOREIGN PATENT DOCUMENTS

| | | | | |
|---|---|---|---|---|
| CH | 182 027 | 1/1936 | | |
| DE | 2 262 836 | 7/1974 | | |
| DE | 34 45 023 A1 | 6/1986 | | |
| EP | 303218 A1 * | 2/1989 | | 24/389 |
| GB | 1 318 360 | 5/1973 | | |

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

The fluidtight zip fastener comprises a pair of fluidtight zip fastener carrying tapes carrying the zip fastener coupling member rows and which are in each case formed by a base tape with a soft, synthetic rubber or similar covering layer. They engage on one another by their edge portions. The pair of continuous coupling member rows is sewn to the zip fastener carrying tapes in a spaced offset position transversely to the longitudinal edges of said carrying tapes in such a way that the press-contact edge portions of the soft covering layers are in contact with one another along a longitudinal plane, which intersects the zip fastener at a central axis thereof and runs at right angles to the zip fastener principal plane. The press-contact edge portions project over said longitudinal plane, when the coupling member rows are disengaged. The edge portions, when the coupling member rows are engaged, are bent away from the side carrying the coupling member rows so as to extend roughly at right angles to the zip fastener principal plane. The soft covering layers of the press-contact edge portions engage on one another under pressure action when the zip fastener is closed and thus ensure the fluidtightness condition.

10 Claims, 3 Drawing Sheets

FLUIDTIGHT ZIP FASTENER

BACKGROUND OF THE INVENTION

1. Field of the Invention

The invention relates to a fluidtight zip fastener, having a pair of fluidtight zip fastener carrying tapes carrying the zip fastener members and whose press-contact edge portions extending longitudinally engage on one another, each carrying tape comprising a base tape with a soft covering layer of synthetic rubber or the like, which covers at least one surface of the base tape in question, a pair of continuous coupling member rows being sewn to the zip fastener carrying tapes in a spatially offset position transversely to the longitudinal edges of the zip fastener carrying tapes in such a way that the press-contact edge portions of the soft covering layers are in contact with one another along a longitudinal plane which intersects the zip fastener at a central axis thereof and which is at right angles to the principal plane of the zip fastener, the press-contact edge portions of the zip fastener carrying tapes projecting over the longitudinal plane in question if the coupling member rows are disengaged.

2. Description of the Related Art

In a known watertight zip fastener of this type (U.S. Pat. No. 4,724,586), the coupling member rows are sewn onto the side of the particular carrying tape provided with the soft covering layer and the portions of the two carrying tapes projecting over the coupling member rows are folded round by in each case 180° towards the side remote from said rows, accompanied by a protective covering of the sewing yarns of the coupling member rows. Even in the latter position, the press-contact edge portions of the zip fastener carrying tapes, in the vicinity of their rearwardly deflected outside, project over the coupling member rows in the case when the latter are disengaged, so that on passing into the engagement position they undergo a compression in the zip fastener principal plane and thereby bring about the sealing action. It has been found that not only the sealing, particularly when a pressure is applied to the sealing area, particularly if gastightness is desired, leaves much to be desired, but also the manufacture of such a zip fastener is complicated, time-consuming and therefore expensive due to the different successive manufacturing steps.

Mention is also made of another known watertight zip fastener having a different construction (U.S. Pat. No. 3,668,745), in which in place of continuous spiral coupling member rows which are in each case sewn to the associated carrying tape, on the outer edge portion of the base tape of the carrying tape, use is made of astride-fixed, wound metallic coupling members in such a way that despite the bending over of the base tape edge portion by 180° in the rearward direction a firm hold is still obtained. In addition, the soft covering layers applied to the sides of the particular base tapes remote from the coupling member rows can project over the coupling member-carrying marginal portions thereof which are folded over rearwards, so that when the coupling members are in the engaged position they come into mutual pressure contact with their faces located in the zip fastener principal plane and thus ensure the sealing action. Quite apart from the fact that this is a zip fastener construction with expensive, metallic individual coupling members, it has proved disadvantageous in connection therewith that following a certain use period the sealing action does not remain adequate.

SUMMARY OF THE INVENTION

The problem of the invention is to so further develop the zip fastener of the aforementioned type that, despite a simpler construction, even during a prolonged period of use, there is a completely satisfactory sealing action both against liquids and gases, even when pressure is applied.

This problem is solved by the fluidtight zip fastener according to the invention, which is essentially characterized in that the press-contact edge portions of the zip fastener carrying tapes, if the coupling member rows are disengaged, project to such an extent over the longitudinal plane in question that said edge portions, when the coupling member rows are in engagement, are bent away from that side carrying the coupling member rows and diverge in such a way that they extend roughly at right angles to the principal plane of the zip fastener, the soft covering layers of the press-contact edge portions of the two zip fastener carrying tapes, which in each case project over the base tape, engage on one another under pressure action and thus ensure the fluidtightness condition. The concept of synthetic rubber or the like ensuring fluidtightness obviously includes all elastomers, including thermoplastics which are active in the case of pressure differences.

An increased sealing action in the closed zip fastener state can be achieved in a particularly simple manner if the portions of the soft covering layers in the vicinity of the press-contact edge portions are kept thicker than in the remaining areas of the zip fastener carrying tapes, so that the compressive forces acting against one another in the coupled state of the coupling member rows are increased. Immediately upstream of the base tape end, whose faces are enveloped by the soft covering material layer projecting over the same and are consequently protected against fraying, there is in this way an increased soft material accumulation, which in the round-terminating area ensures an overpressing, so that this counteracts the otherwise feared V-shaped expanding of the edge zones of the carrying tape edge portions.

The handling of the zip fastener, particularly during the closing process, is aided in a further advantageous embodiment of the invention in that the press-contact edge portions of the zip fastener carrying tapes which when the coupling member rows are disengaged project over the longitudinal plane in question, are so preshaped that they terminate in a plane inclined with respect to the zip fastener principal plane and form an acute angle with the latter. An angle of approximately 20 to 40° has proved highly appropriate. The choice of the suitable angle is naturally dependent on the hardness of the material of the covering layers.

An important parameter for a satisfactory sealing function is also the dimensioning of the individual zip fastener layers. It has proved very advantageous if the soft covering layers of the two zip fastener carrying tapes have a thickness equal to or smaller than the thickness of the two base tapes. Appropriately the thickness of the base tapes is approximately 0.6 mm and the total thickness of the zip fastener carrying tapes approximately 1 mm.

The outer faces of the soft covering layers extending transversely to the zip fastener principal plane and projecting over the end of the associated base tape can be made smooth. However, it has been found that it is appropriate to provide said areas of the soft covering layers of one carrying tape, which come into contact with corresponding outer faces of the covering layers of the other carrying tape, with in each case a roughening or a profiling. It has proved advantageous if the profiling is formed by successive elevations and depressions of the outer faces extending parallel to the coupling member rows.

The invention is also directed at a special construction of the zip fastener slider, which in the conventional manner has a lower plate and an upper plate, as well as a slider wedge interconnecting the two plates. According to the invention, in the central area of the slider wedge is formed a projecting guide flange extending between the upper and lower plates and which on either side of the slider wedge separates the first two chambers receiving the coupling member rows from the two second chambers receiving the press-contact edge portions of the zip fastener carrying tapes.

The outer edge of the guide flange appropriately has a substantially constant spacing from the guide flange-carrying slider wedge.

BRIEF DESCRIPTION OF THE DRAWINGS

Further details, advantages and features of the invention can be gathered from the following description relative to the attached drawings.

PREFERRED EMBODIMENTS OF THE INVENTION

Figure 1:
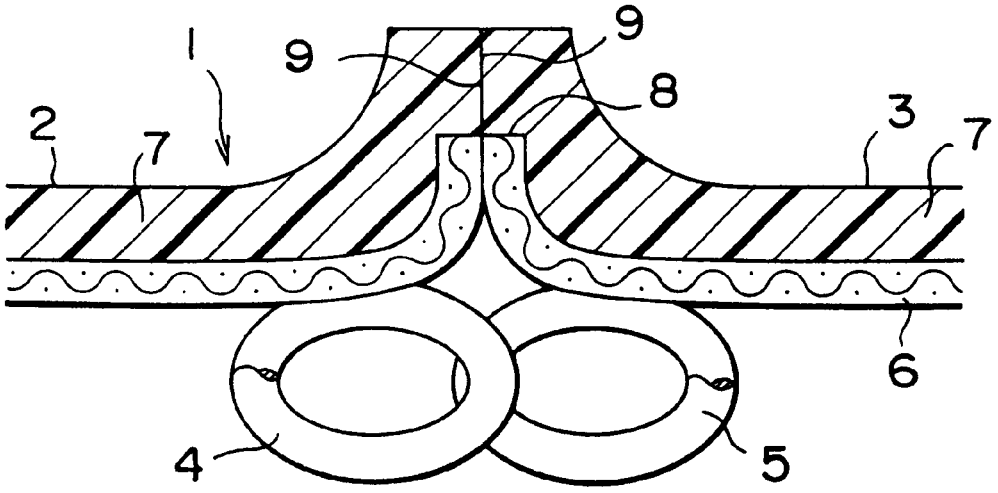
FIG. 1 is a diagrammatic front view of a fluidtight zip fastener in the closed state.

The zip fastener 1 illustrated in the drawings in conventional manner comprises two zip fastener carrying tapes 2, 3 with zip fastener member rows 4, 5 sewn thereto. Each of the carrying tapes 2, 3 comprises a base tape 6 made from a woven fabric, e.g. from polyester or some other synthetic material. However, it is also possible for the base tape 6 to be formed from cotton threads.

On its side remote from the coupling member rows 4,5, each base tape 6 is provided with a synthetic rubber, soft covering layer 7. This term in general manner covers elastomers, but thermoplastics can also be used for coating the base tape 6.

As is apparent from the drawings, the covering layer 7 projects over an end 8 of the base tape 6 and completely covers the same. Even in the case of prolonged use, this ensures that the base tape 6 cannot fray at this point.

It can also be seen that the continuous coupling member rows 4, 5 are sewn to the zip fastener carrying tapes 2, 3 in a spaced of offset position transversely to the longitudinal edges of said tapes, in such a way that press-contact edge portions 9 of the soft covering layers 7 are in contact with one another along a longitudinal plane. The latter intersects the zip fastener at a central axis thereof and runs at right angles to the zip fastener principal plane. The press-contact edge portions 9 of the zip fastener carrying tapes 2, 3 project over the longitudinal plane in question, if the coupling member rows 4, 5 are disengaged and namely project over said longitudinal plane to such an extent that said edge portions, when the coupling member rows 4, 5 are in engagement, are bent away from the side carrying said rows and diverge in such a way that they extend roughly at right angles to the zip fastener principal plane. The soft covering layers 7 of the press-contact edge portions 9 of the two zip fastener carrying tapes 2, 3, which in each case project over the base tape 6, engage under pressure action on one another and consequently ensure the fluidtightness condition.

As can in particular be gathered from FIG. 1, the portions of the soft covering layers 7 are kept thicker in the vicinity of the press-contact edge portions 9 than in the remaining areas of the zip fastener carrying tapes. Thus, there is an increase in the compressive forces acting against one another when the coupling member rows 4, 5 are in the coupled state. The increased mass of the material of the soft covering layers 7 in the expansion area and therefore curvature area directly upstream of the end of the base tape 6 ensure an overpressing of the press-contact edge portions 9 of the carrying tapes 2, 3 and consequently ensure that there is no V-shaped expansion in this area.

The press-contact edge portions 9 of the zip fastener carrying tapes 2, 3, which, when the coupling member rows 4, 5 are disengaged, project over the longitudinal plane in question, are appropriately so preshaped that in a plane inclined with respect to the zip fastener principal plane they form an acute angle with the principal plane. The acute angle is, as a function of the hardness of the material forming the soft covering layer 7, approximately 20 to 40°. The soft covering layers 7 of the two zip fastener carrying tapes 2, 3 have a thickness equal to or somewhat smaller than the thickness of the two base tapes 6. In practice, the thickness of the base tapes 6 is approximately 0.6 mm and the total thickness of the zip fastener carrying tapes 2, 3 is approximately 1 mm.

The outer faces or edge portions 9 of the soft covering layers 7 projecting over the end of the associated base tape 6 and extending transversely to the zip fastener principal plane are appropriately provided with a roughening or profiling. The latter can be formed by successive elevations and depressions of the outer faces extending parallel to the coupling member rows 4, 5.

Figure 2:
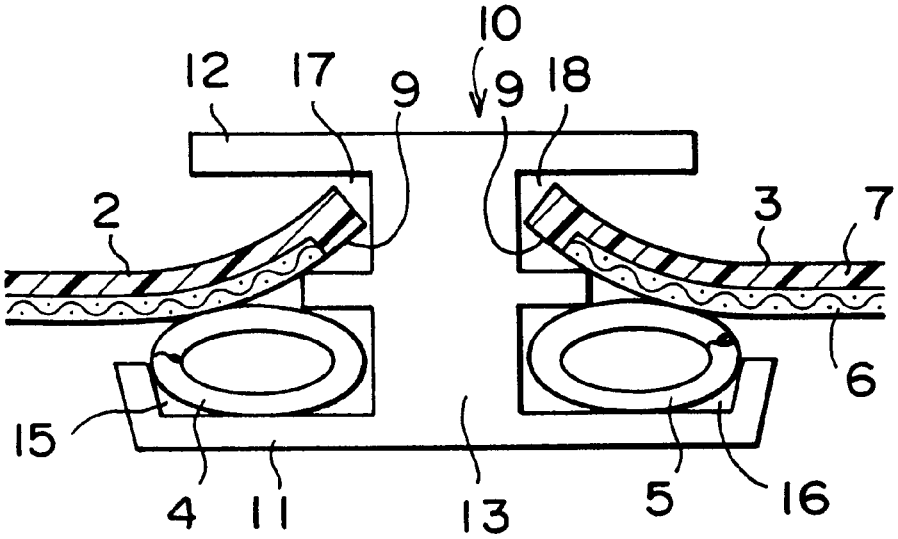
FIG. 2 is a diagrammatic front view of the zip fastener in FIG. 1 in the state of opening and closing by a slider.
Figure 3:
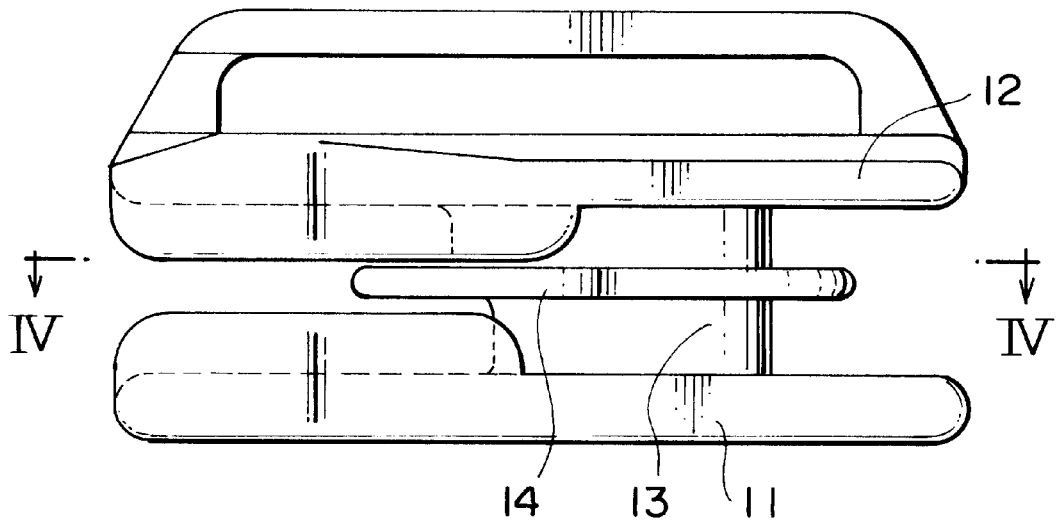
FIG. 3 is a side view of the slider used.
Figure 4:
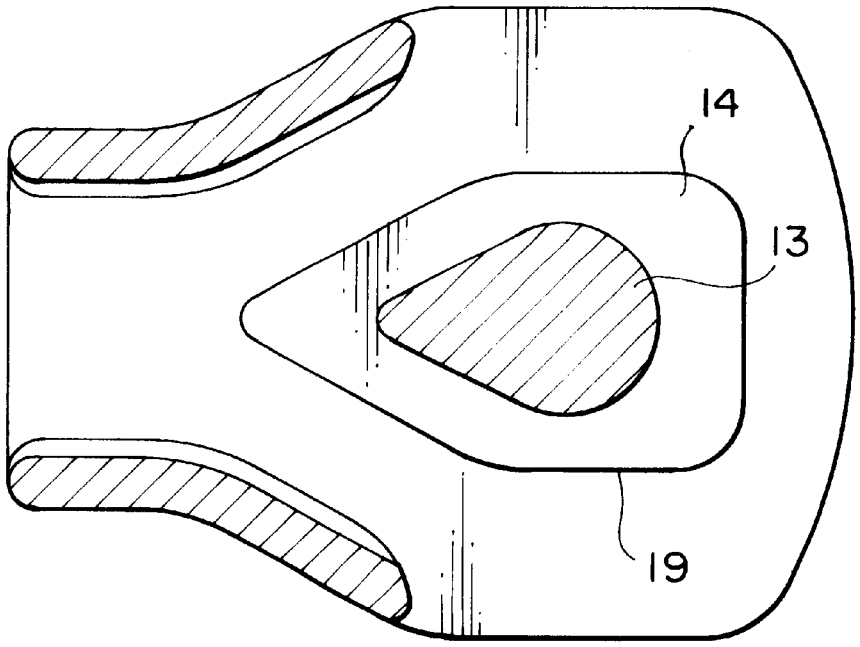
FIG. 4 is a plan view of the slider according to FIG. 3, partly in section corresponding to line IV—IV in FIG. 3.
Figure 5:
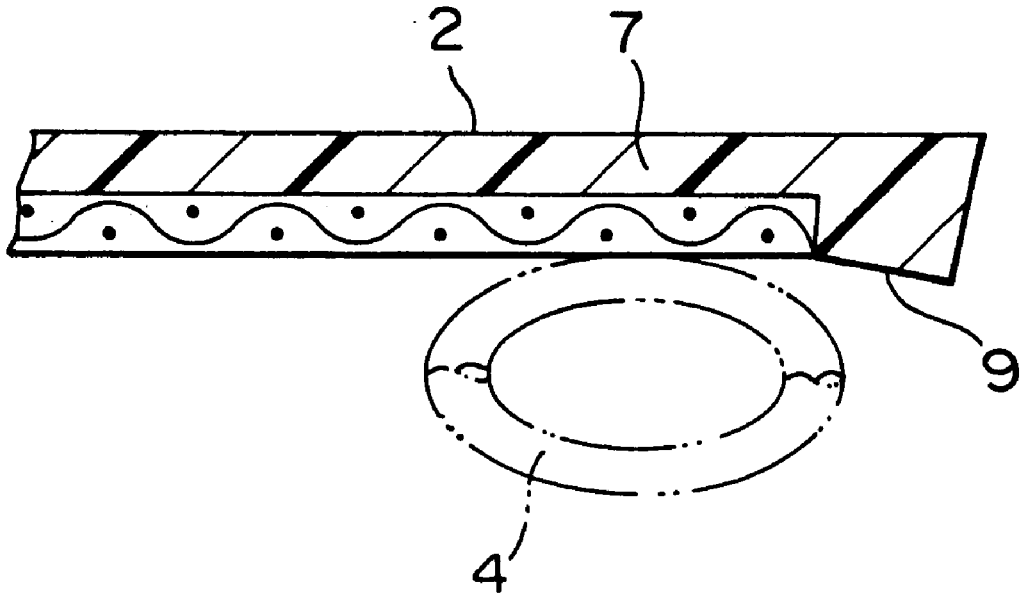
FIG. 5 is a diagrammatic front view of one zip fastener carrying tape.

The zip fastener slider 10 engaging the zip fastener carrying tapes 2, 3 and passing same in the case of longitudinal sliding into the open or closed position, shown in FIGS. 2 to 4, comprises a lower plate 11 and an upper plate 12, as well as a slider wedge 13 interconnecting the two plates. In the central area of the slider edge 13, a projecting guide flange 14 extending roughly parallel between the upper plate 12 and lower plate 11 is provided. On either side of the slider wedge 13, said guide flange 14 separates the first two chambers 15 and 16 receiving the coupling member rows 4, 5 from the two second chambers 17, 18 receiving the press-contact edge portions 9 of the zip fastener carrying tapes 2, 3. As can in particular be gathered from FIG. 4, the outer edge 19 of the guide flange 14 has a substantially constant spacing from the guide flange-carrying slider wedge 13.

What is claimed is:

1. A fluidtight zip fastener, having a slider and a pair of fluidtight zip fastener carrying tapes carrying zip fastener members and whose edge portions engage on one another, each carrying tape comprising a base tape with a soft covering layer of synthetic rubber, which covers at least one surface of the base tape, a pair of continuous coupling member rows being sewn to the zip fastener carrying tapes in a spatially offset position transversely to the longitudinal edges of the zip fastener carrying tapes such that press-contact edge portions of the soft covering layers are in contact with one another along a longitudinal plane, which intersects the zip fastener at a central axis thereof and which is at right angles to the principal plane of the zip fastener. the press-contact edge portions of the zip fastener carrying tapes projecting over the longitudinal plane when the coupling member rows are disengaged, wherein the press-contact edge portions of the zip fastener carrying tapes, when the coupling member rows are disengaged, wherein the press-contact edge portions of the zip fastener carrying tapes, when the coupling member rows are disengaged, project over the longitudinal plane such that said edge portions, when the coupling member rows are in engagement, are bent away from that side carrying the coupling member rows and diverge extending roughly at right angles to the principal plane of the zip fastener, the soft covering layers of the press-contact edge portions of the two zip fastener carrying tapes, which project over the base tape, engage on one another under pressure action and thus ensure a fluidtightness condition.

2. The zip fastener according to claim 1, wherein portions of the soft covering layers, in the vicinity of the press-contact edge portions, are thicker than in the remaining areas of the zip fastener carrying tapes, so that the compressive forces acting against one another in the coupled state of the coupling member rows are increased.

3. The zip fastener according to claim 1, wherein the press-contact edge portions of the zip fastener carrying tapes, which project over the longitudinal plane when the coupling member rows are disengaged, are so preshaped that they terminate in a plane inclined with respect to the zip fastener principal plane and forming an acute angle with the latter.

4. The zip fastener according to claim 2, wherein an angle is approximately 20 to 40°.

5. The zip fastener according to claims 1, 2, 3 or 4, wherein the soft covering layers of the two zip fastener carrying tapes have a thickness equal to or smaller than the thickness of the two base tapes.

6. The zip fastener according to claim 5, wherein the thickness of the base tapes is roughly 0.6 mm and the total thickness of the zip fastener carrying tapes is approximately 1 mm.

7. The zip fastener according to claims 1, 2, 3 or 4, wherein the outer faces, extending transversely to the zip fastener principal plane, of the soft covering layers projecting over an end of the associated base tape, are provided with a roughening or profiling.

8. The zip fastener according to claim 7, wherein the profiling is formed by successive elevations and depressions of the outer faces extending parallel to the coupling member rows.

9. The zip fastener according to claims 1, 2, 3 or 4, having the zip faster slider engaging the zip fastener carrying tapes and transferring the zip fastener slider into the open or closed position in the case of longitudinal sliding and which comprises a lower plate and an upper plate, as well as a slider wedge interconnecting said lower and upper plates, characterized in that a projecting guide flange is formed in a central area of the slider wedge and extends parallel between the upper plate and lower plate and which on either side of the slider wedge separates two first chambers receiving the coupling member rows from the two second chambers receiving the press-contact edge portions of the zip fastener carrying tapes.

10. The zip fastener according to claim 9, wherein an outer edge of the guide flange has a substantially constant spacing from the guide flange-carrying slider wedge.

* * * * *